US010179274B2

(12) United States Patent
Louie

(10) Patent No.: US 10,179,274 B2
(45) Date of Patent: Jan. 15, 2019

(54) SYSTEM AND METHOD FOR AN EXTENDED CHESS GAME

(76) Inventor: Sarah Waiyan Louie, Saratoga, CA (US)

( * ) Notice: Subject to any disclaimer, the term of this patent is extended or adjusted under 35 U.S.C. 154(b) by 33 days.

(21) Appl. No.: 13/414,681

(22) Filed: Mar. 7, 2012

(65) Prior Publication Data

US 2013/0157740 A1 Jun. 20, 2013

Related U.S. Application Data

(60) Provisional application No. 61/570,630, filed on Dec. 14, 2011.

(51) Int. Cl.
*A63F 3/02* (2006.01)
*A63F 3/00* (2006.01)

(52) U.S. Cl.
CPC ..... *A63F 3/02* (2013.01); *A63F 3/00643* (2013.01); *A63F 2003/00996* (2013.01)

(58) Field of Classification Search
USPC ..... 463/14
See application file for complete search history.

(56) References Cited

U.S. PATENT DOCUMENTS

| | | | | |
|---|---|---|---|---|
| 1,713,455 | A * | 5/1929 | Stickney | 273/262 |
| 5,511,793 | A * | 4/1996 | Watt | 273/260 |
| 6,446,966 | B1 * | 9/2002 | Crozier | 273/236 |
| 6,719,289 | B1 * | 4/2004 | Brown et al. | 273/260 |
| 2003/0109310 | A1 * | 6/2003 | Heaton et al. | 463/42 |
| 2010/0327528 | A1 * | 12/2010 | Spurgeon | 273/260 |

* cited by examiner

*Primary Examiner* — Tramar Harper
(74) *Attorney, Agent, or Firm* — James M. Smedley LLC; James Michael Smedley, Esq.

(57) ABSTRACT

A chess-type game played on a game board of ten columns and eight rows, or ten columns and ten rows. The game is played with traditional chess game pieces plus additional wizard game pieces. During a turn the wizard game pieces can be moved one space away in any direction, or alternately can be exchanged with any other game piece on the board belonging to the same set.

8 Claims, 6 Drawing Sheets

SYSTEM AND METHOD FOR AN EXTENDED CHESS GAME

CROSS-REFERENCE TO RELATED APPLICATIONS

This application claims the benefit of the following provisional applications, each of which is hereby incorporated by reference in its entirety: U.S. Pat. App. No. 61/570,630 filed on Dec. 14, 2011 and entitled "EXTENDED CHESS GAME."

FIELD OF THE INVENTION

The present invention relates generally to games and methods of playing games, and in particular to a system and method for playing a chess-like game having more game pieces than traditional chess.

BACKGROUND OF THE INVENTION

Chess is a well-known board game that has been enjoyed by players for centuries. Chess is a game played between two players who each move their own game pieces around a board. A traditional chess board has sixty-four squares arranged into eight rows and eight columns. Each player has a set of game pieces that the player can move during his turn, with each game piece having a specific set of permissible movement patterns. The players take turns moving game pieces one at a time in an attempt to capture the other player's game pieces. A player can win the game by moving his game pieces such that the other player's game piece known as the king cannot be moved without being placed in a position in which the king could be captured, a situation known as checkmate.

The standard rules of chess can be found at http://www.chess.com/learn-how-to-play-chess.html (last accessed Dec. 13, 2011), herein incorporated by reference.

Although players can employ numerous and sometimes complicated strategies during gameplay depending on the situation and the arrangement of the game pieces on the game board, the player is limited to moving each game piece according to that game piece's set of permissible movement patterns and the traditional rule of chess. Some players may wish to play a variation on the game that is similar to chess, but introduces different rules and different game pieces that have different permissible movement patterns.

Therefore, there is a need in the art for a system and method for playing an extended version chess game that allows for alternate permissible movement patterns of one or more of the game pieces. These and other features and advantages of the present invention will be explained and will become obvious to one skilled in the art through the summary of the invention that follows.

SUMMARY OF THE INVENTION

Accordingly, the present invention relates to a system and method for playing a chess-like game that generally follows the normal rules of chess, but is played on a game board having eight rows and ten columns, and uses an additional game piece known as the wizard. In addition to traditional chess game pieces, each player uses two wizard game pieces. The wizard game piece can move similarly to the king game piece, but can also be exchanged for any of the player's other game pieces on the board that have not yet been captured.

According to an embodiment of the present invention, an extended chess game includes: a game board comprising spaces arranged in rows and columns; two sets of game pieces, each set of game pieces comprising: ten pawns; two rooks; two knights; two wizards; two bishops; one queen; and one king.

According to an embodiment of the present invention, the game board comprises eighty spaces arranged in ten columns and eight rows.

According to an embodiment of the present invention, the game board comprises eighty spaces arranged in ten columns and ten rows.

According to an embodiment of the present invention, the wizards are permitted, during a turn, to be exchanged with any other game piece belonging to the same set of game pieces or alternately to move in any direction to a space one space away.

According to an embodiment of the present invention, the extended chess game is played on one or more computing devices.

According to an embodiment of the present invention, the one or more computing devices comprise of one or more of a laptop, a desktop, a mobile phone, a tablet PC, a smartphone, an interactive television, a console gaming system and a handheld gaming system.

According to an embodiment of the present invention, the extended chess game is played on two computing devices, wherein each one of the two computing devices is commutatively connected to the other of the two computing devices.

According to an embodiment of the present invention, a method for playing an extended chess game includes the steps of: providing a game board comprising spaces arranged in rows and columns; providing two sets of game pieces, each set of game pieces comprising: providing ten pawns; providing two rooks; providing two knights; providing two wizards, wherein each of said wizards is permitted during a turn to be exchanged with any other game piece belonging to the same set of game pieces or alternately to move in any direction to a space one space away; providing two bishops; providing one queen; and providing one king.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
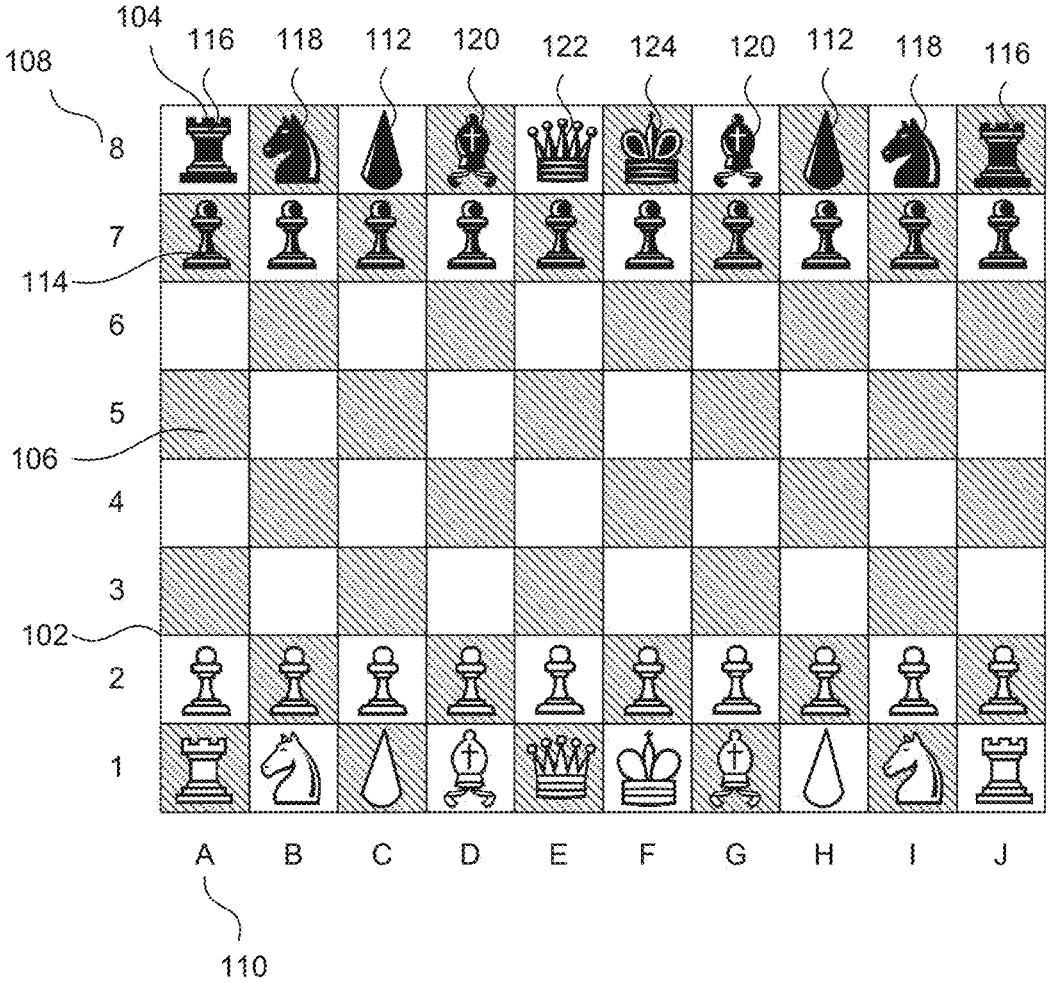
FIG. 1 depicts a game board, in accordance with an embodiment of the present invention.

FIG. 1 depicts a game comprising a game board 102 and a plurality of game pieces 104. The game board 102 can comprise spaces 106 arranged in rows 108 and columns 110. In some embodiments, the spaces 106 can be squares. In some embodiments, the spaces 106 can alternate colors throughout each row 108 and each column 110, such as in a traditional chess board or checker board, as shown in FIG. 1. In alternate embodiments, the spaces 106 can be any color desired. In some embodiments, the game board 102 can have eight rows 108 and ten columns 110. In alternate embodiments, the game board 102 can have ten rows 108 and ten columns 110.

Each game piece 104 can be a wizard 112, a pawn 114, a rook 116, a knight 118, a bishop 120, a queen 122, or a king 124. The game pieces 104 can be grouped into a first set and a second set. The first set and the second set can each comprise ten pawns 114, two rooks 116, two knights 118, two wizards 112, two bishops 120, one queen 122, and one king 124. In some embodiments, the game pieces 104 belonging to the first set can be a different color and/or have different shapes than the game pieces belonging to the second set. By way of a non-limiting example, the game pieces 104 belonging to the first set can be white, and the game pieces 104 belonging to the second set can be black, as shown in FIG. 1. One of ordinary skill in the art would appreciate that there are numerous methods for differentiating the game pieces belonging to a first set and a second set, and embodiments of the present invention are contemplated for use with any method for differentiating the game pieces belonging to a first set and a second set.

Figure 2:
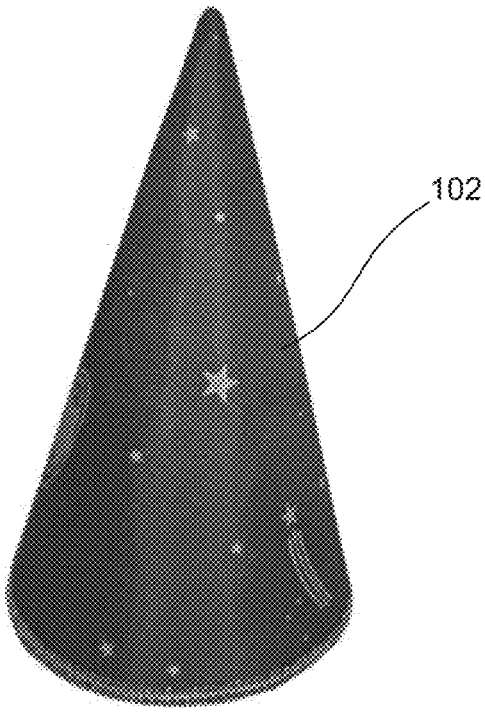
FIG. 2 depicts a wizard game piece, in accordance with an embodiment of the present invention.

FIG. 2 depicts an embodiment of a wizard game piece 112. In some embodiments, the wizard game piece 112 can have a conical shape with a circular base extending upward on all sides to a point. In alternate embodiments, the wizard game piece 112 can be in the shape of a humanoid figure wearing robes and a pointed hat, a literary or popular culture character, a geometric shape, a product, or have any other shape. In some embodiments, the other game pieces 104 can be shaped as traditional chess pieces. In alternate embodiments, the other game pieces 104 can each have any shape desired. One of ordinary skill in the art would appreciate that there are numerous shapes and/or designs that could be utilized with the various game pieces 104 utilized in embodiments of the present invention, and embodiments of the present invention re contemplated for use with game pieces of any shape and/or design.

Referring back to FIG. 1, the game pieces 104 can be placed on the spaces 106 of the game board 102. In some embodiments, the game pieces 104 of the first set can be placed in rows 1 and 2, and the game pieces 104 of the second set can be placed in rows 7 and 8. The game pieces 104 of the first set can be placed at the following spaces 106: a rook at space A-1, a knight at space B-1, a wizard at space C-1, a bishop at space D-1, the queen at space E-1, the king at space F-1, a bishop at space G-1, a wizard at space H-1, a knight at space I-1, a rook at space J-1, and the pawns on each space on row 2. The game pieces 104 of the second set can be placed at the following spaces 106: a rook at space A-8, a knight at space B-8, a wizard at space C-8, a bishop at space D-8, the queen at space E-8, the king at space F-8, a bishop at space G-8, a wizard at space H-8, a knight at space 1-8, a rook at space J-8, and the pawns on each space on row 7. In alternate embodiments having ten rows 108, the game pieces 104 of the second set can be placed in the corresponding spaces 106 in rows 9 and 10 instead of rows 7 and 8.

The game can be played by a first player and a second player substantially according to the standard rules of chess, except as modified as described below. The first player and the second player can each take turns moving game pieces 104 around the game board 102. The first player can move game pieces 104 belonging to the first set. The second player can move game pieces 104 belonging to the second set. Each player can normally move one game piece 104 per turn, except in limited situations in which more than one game piece 104 is moved such as castling and the wizard game piece's exchange movement described below in reference to FIG. 4. The players can capture game pieces 104 belonging to the opposing set by moving their game pieces 104 to a space 106 occupied by a game piece 104 belonging to the opposing set. The game piece 104 belonging to the opposing set can then be removed from the game board 102.

Each type of game piece 104 can be moved according to a specific set of permissible movement patterns. The rook 116, knight 118, bishop 120, queen 122, king 124, and pawn 114 game pieces can each have a specific set of permissible movement patterns according to the standard rules of chess. For example, the king game piece 124 can normally be moved one space forward, left, right, backwards, or diagonally during a turn, but can be moved two spaces left or right during a castling move.

Figure 3:
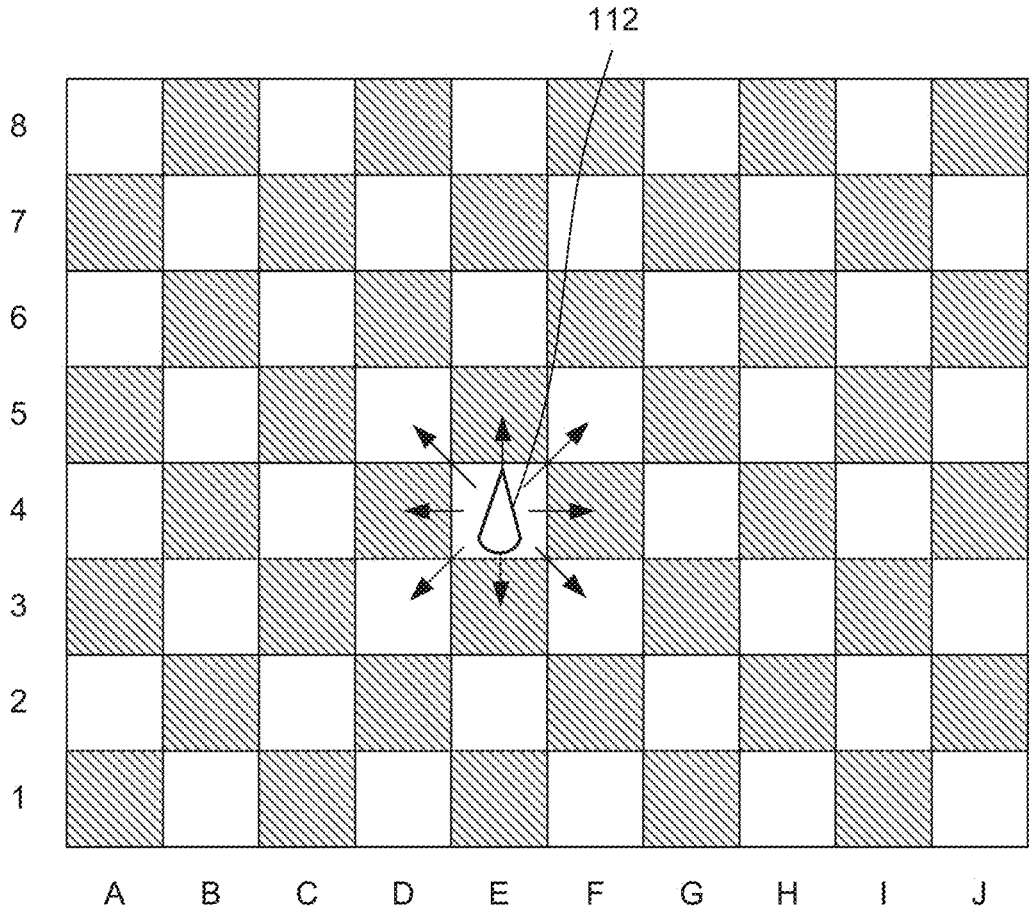
FIG. 3 depicts a set of possible movements for a wizard game piece, in accordance with an embodiment of the present invention.

The wizard game piece 112 can have a set of permissible movement patterns comprising standard movements and an exchange movement. During a single turn, a player can choose to move a wizard game piece 112 either according to the standard movements or the exchange movement, but cannot move the wizard game piece 112 according to the standard movements and the exchange movements during the same turn. FIG. 3 depicts the standard movements of the wizard game piece 112. The wizard game piece can be moved one space forward, left, right, backwards, or diagonally during each turn. The wizard game piece's standard movements can be similar to the king game piece's set of permissible movement patterns, except that the wizard game piece 112 cannot participate in the castling move. By way of a non-limiting example, the wizard game piece 112 shown at space E-4 in FIG. 3 can be moved during a turn to one of the following spaces: D-5, E-5, F-5, D-4, F-4, D-3, E-3, and F-3.

Figure 4:
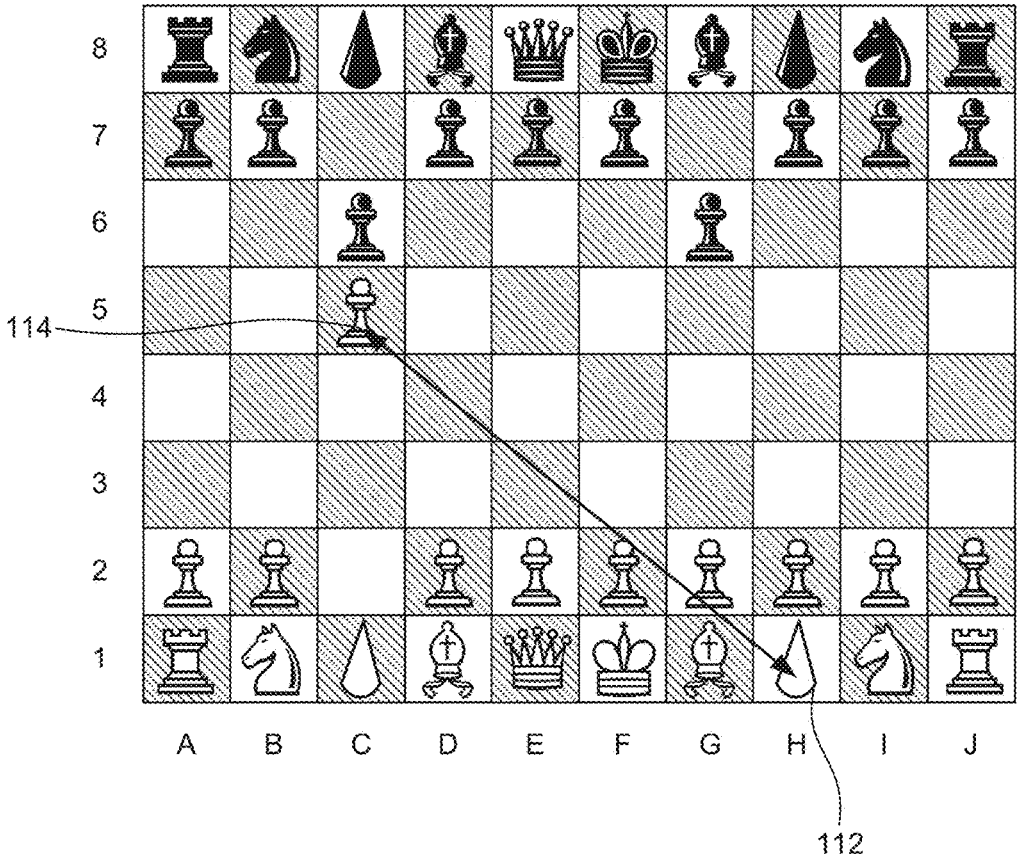
FIG. 4 depicts a wizard game piece's exchange movement, in accordance with an embodiment of the present invention.

The exchange movement can alternately allow a wizard game piece 112 belonging to one set to be exchanged with any other game piece 104 remaining on the game board 102 that belongs to the same set. By way of a non-limiting example, as shown in FIG. 4, the wizard game piece 112 at space H-1 can be exchanged with the pawn game piece 114 at space C-5, such that the wizard game piece 112 moves to space C-5 and the pawn game piece 114 moves to space H-1. The wizard game piece 112 at space H-1 cannot be exchanged with the pawn game piece 114 at space C-6 because the pawn game piece 114 at space C-6 belongs to the opposing set. When exercised, the exchange movement completes a player's turn, and the game pieces 104 that were exchanged cannot be moved further during that turn.

Figure 5:
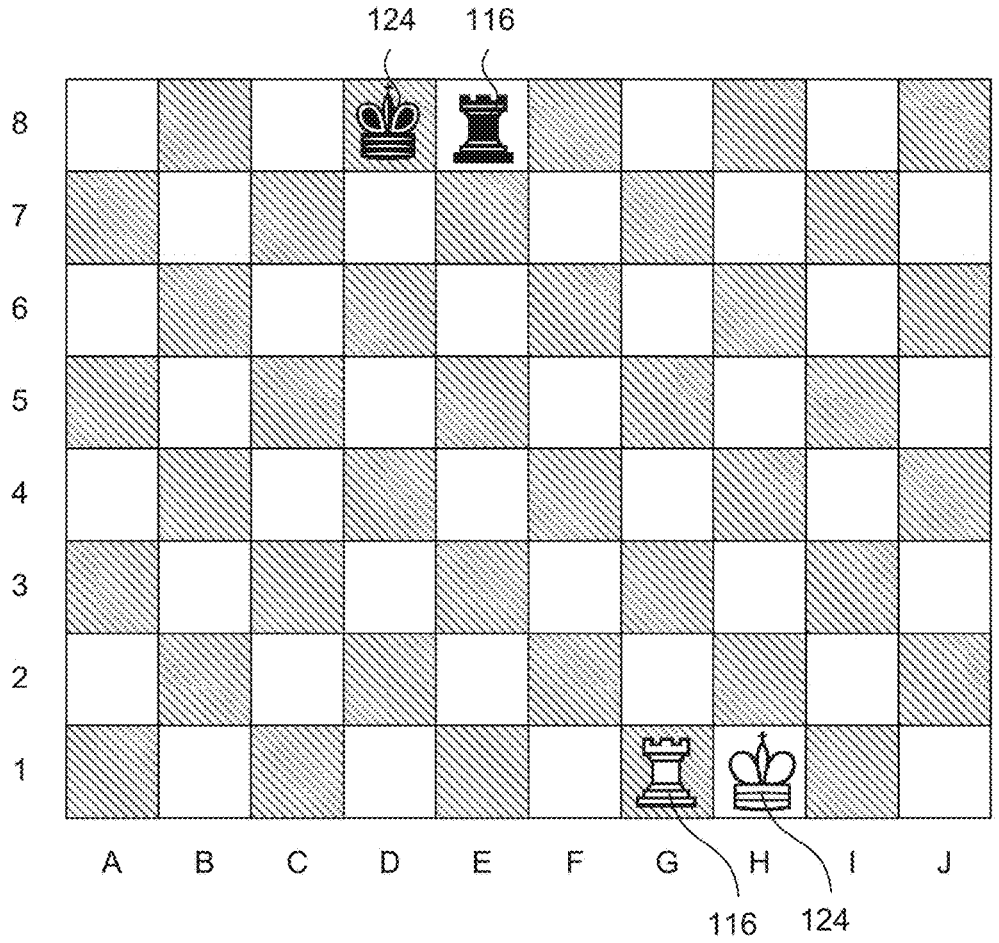
FIG. 5 depicts exemplary embodiments of castling movements, in accordance with an embodiment of the present invention.

All other rules of the game can be the same as the rules of traditional chess. For example, check, checkmate, draws, promotion of pawns, en passant, and other rules can operate in the same way as in traditional chess. Castling can also be available in the same situations as traditional chess, and can function substantially in the same manner as traditional chess, such that the king game piece 124 can be moved two spaces to the left or right toward a rook game piece 116 when no other game pieces 104, including the wizard game piece 112, are between the king game piece 124 and the rook game piece 116. The rook game piece 116 can be moved to the opposite side of the king game piece 124. As compared to traditional chess, the rook game piece 116 can be moved one additional space 106 during the castling move to account for the two extra columns 110 on the game board 102. By way of a non-limiting example, the king game piece 124 of the first set can be moved from its initial position at space F-1 two spaces to the right to space H-1, and a rook game piece 116 of the first set can be moved from its initial position at space J-1 three spaces to the left to space G-1 on the opposite side of the king game piece 124, as shown in FIG. 5. By way of another non-limiting example, the king game piece 124 of the second set can be moved from its initial position at space F-8 two spaces to the left to space D-8, and a rook game piece 116 of the second set can be moved from its initial position at space A-8 four spaces to the right to space E-8 on the opposite side of the king game piece 124, as shown in FIG. 5.

In some embodiments, the game can be played on a physical game board 102 with physical game pieces 104. In alternate embodiments, the game can be played as a video game (e.g, computer program, application for a mobile phone, game on a web site) or any other physical or non-physical representation.

Figure 6:
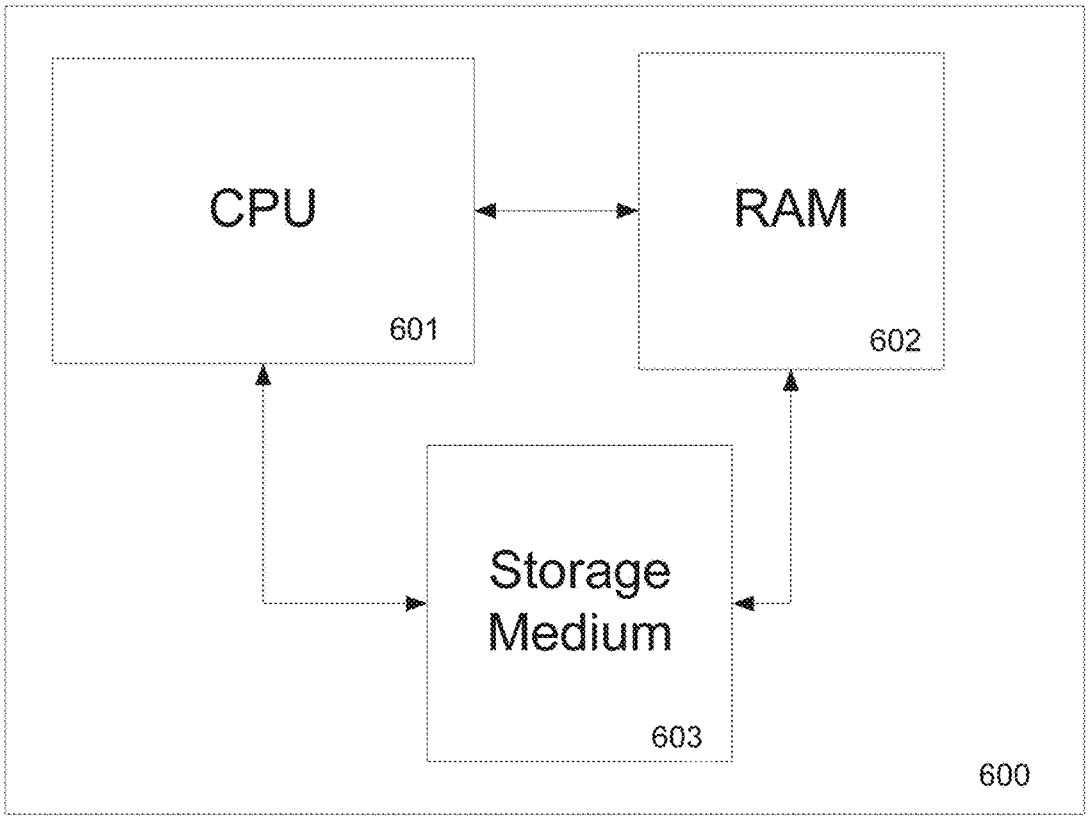
FIG. 6 depicts an exemplary computing device for playing the game as a video game.

According to an embodiment of the present invention, when the game is played as a video game, the system and method is accomplished through the use of one or more computing devices. As shown in FIG. 6, One of ordinary skill in the art would appreciate that a computing device 600 appropriate for use with embodiments of the present application may generally be comprised of one or more of a Central processing Unit (CPU) 601, Random Access Memory (RAM) 602, and a storage medium (e.g., hard disk drive, solid state drive, flash memory, cloud storage) 603. Examples of computing devices usable with embodiments of the present invention include, but are not limited to, laptops, desktops, mobile phones, tablet PCs, smartphones, interactive televisions, console gaming systems and handheld gaming systems. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present invention are contemplated for use with any computing device. One of ordinary skill in the art would further appreciate that the game may be played by two separate players on one or more computing devices, either centrally located or located remotely and communicatively connected via one or more networks.

Traditionally, a video game consists of a finite sequence of computational instructions or program instructions. It will be appreciated that a programmable apparatus (i.e., computing device) can receive such a video game and, by processing the computational instructions thereof, produce a further technical effect.

A programmable apparatus includes one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the video game and hardware described herein.

Embodiments of the system as described herein are not limited to applications involving conventional video games or programmable apparatuses that run them. It is contemplated, for example, that embodiments of the invention as claimed herein could include an optical computer, quantum computer, analog computer, or the like.

Regardless of the type of computer program or computer involved, a video game can be loaded onto a computer to produce a particular machine that can perform any and all of the depicted functions. This particular machine provides a means for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Program instructions of the video game can be stored in a computer-readable memory capable of directing a computer or other programmable data processing apparatus to function in a particular manner. The program instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

It will be appreciated that program instructions may include computer executable code. A variety of languages for expressing computer program instructions are possible, including without limitation C, C++, Java, JavaScript, assembly language, Lisp, and so on. Such languages may include assembly languages, hardware description languages, database programming languages, functional programming languages, imperative programming languages, and so on. In some embodiments, computer program instructions can be stored, compiled, or interpreted to run on a computer, a programmable data processing apparatus, a heterogeneous combination of processors or processor architectures, and so on. Without limitation, embodiments of the system as described herein can take the form of web-based computer software, which includes client/server software, software-as-a-service, peer-to-peer software, or the like.

In some embodiments, a computer enables execution of program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computer can process these threads based on priority or any other order based on instructions provided in the program code.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

What is claimed is:

1. A method of playing an extended chess game, comprising:

providing an extended chess game consisting of a game board having spaces arranged in rows and columns and two sets of game pieces; placed on the game board, each set of games pieces consisting of:

ten pawns;
two rooks;
two knights;
two wizards;
two bishops;
one queen; and
one king;

moving at least one of said two wizards according to a standard movement ability and an exchange movement ability of the two wizards;

wherein said exchange movement ability consists of exchanging one of said two wizards with any other allied game piece located at a position on the game board that is three or more spaces away from said wizard's current position; and wherein said standard movement ability consists of moving at least one of the two wizards one adjacent space in any direction on the game board.

2. The method of the playing the extended chess game of claim 1, wherein said game board has eighty spaces arranged in ten columns and eight rows.

3. The method of the playing the extended chess game of claim 1, wherein said game board has one hundred spaces arranged in ten columns and ten rows.

4. The method of the playing the extended chess game of claim 1, wherein the extended chess game is played on one or more computing devices.

5. The method of the playing the extended chess game of claim 4, wherein the one or more computing devices comprise of one or more of a laptop, a desktop, a mobile phone, a tablet PC, a smartphone, an interactive television, a console gaming system and a handheld gaming system.

6. The method of the playing the extended chess game of claim 1, wherein the extended chess game is played on two computing devices, wherein each one of the two computing devices is commutatively connected to the other of the two computing devices.

7. A method of playing an extended chess game, comprising:

providing an extended chess game consisting of a game board having spaces arranged in rows and columns two sets of game pieces, placed on the game board, each set of game pieces consisting of:

ten pawns;
two rooks;
two knights;
two wizards;
two bishops;
one queen; and
one king;

moving each wizard according to a standard movement ability and an exchange movement ability of each wizard;

wherein said exchange movement ability consists of exchanging one of said two wizards with any other allied game piece located anywhere on the game board, including two or more spaces away from said wizard's current position; and wherein said standard movement ability consists of moving the wizard one adjacent space in any direction on the game board.

8. A method of playing an extended chess game, comprising:

providing an extend chess board game consisting of a game board having spaces arranged in rows and columns; and two sets of game pieces placed on the game board, each set of game pieces consisting of:

ten pawns;
two rooks;
two knights;
two wizards;
two bishops;
one queen; and one king;

moving each wizard during a turn of the game according to a standard movement ability and an exchange movement ability of each wizard;

wherein said exchange movement ability consists of exchanging one of said two wizards with any other allied game piece located anywhere on the game board, including two or more spaces away from said wizard's current position and thereafter no further movement is allowed during the turn; and wherein said standard movement ability consists of moving the wizard one adjacent space in any direction on the game board.

* * * * *